US006296151B1

(12) United States Patent
Chen

(10) Patent No.: US 6,296,151 B1
(45) Date of Patent: Oct. 2, 2001

(54) PERFUME SPRAYER

(76) Inventor: Sin-Hsiung Chen, P.O. Box 90, Tainan City (TW)

( * ) Notice: Subject to any disclaimer, the term of this patent is extended or adjusted under 35 U.S.C. 154(b) by 0 days.

(21) Appl. No.: 09/800,651

(22) Filed: Mar. 8, 2001

(51) Int. Cl.[7] ..... B67D 5/06
(52) U.S. Cl. ..... 222/183; 222/182; 222/153.13
(58) Field of Search ..... 222/183, 182, 222/402.1, 153.11, 153.13

(56) References Cited

U.S. PATENT DOCUMENTS 2,765,959 * 10/1956 Elliott ..... 222/181
4,662,541 * 5/1987 Fossati ..... 222/135
4,789,083 * 12/1988 Gutierrez ..... 222/108
5,348,193 * 9/1994 Bruckner et al. ..... 222/175
5,358,147 * 10/1994 Adams et al. ..... 222/183
5,458,263 * 10/1995 Ciammitti et al. ..... 222/153.1
5,487,489 * 1/1996 Weiss et al. ..... 222/1
5,516,006 * 5/1996 Meshberg ..... 222/25

* cited by examiner

*Primary Examiner*—Kevin Shaver
*Assistant Examiner*—F. Nicolas

(57) ABSTRACT

A perfume sprayer includes a left half housing consisting of an upper and a lower cap, a right half housing consisting of an upper and a lower cap, a gasket in the left upper cap, a control member deposited on the gasket, a perfume bottle contained in a bag and placed in the left lower cap. A spray head fixed on the bottle has a spray nozzle in a recess of the left upper cap. After the two half housings are combined together and when the left and the right lower caps are pressed, the bottom of the bottle is pushed up by push blocks of the two lower caps to force the bottle move up along the push blocks and then the spray nozzle sprays the perfume out of the spray head. Thus, the perfume sprayer is easy to use and to carry out, a beautiful configuration.

6 Claims, 3 Drawing Sheets

PERFUME SPRAYER

BACKGROUND OF THE INVENTION

1. Field of the Invention

This invention relates to a perfume sprayer, particularly to one provided with an left half housing consisting of a left upper cap and a left lower cap, and a right half housing consisting of a right upper cap and a right lower cap, a bag contained in the left lower cap and a bottle placed in the bag. In using the perfume sprayer, pressing manually the left lower cap and the right lower cap, the perfume stored in the bottle is sprayed out upward, very convenient to use and carry along.

2. Description of the Prior Art

Common conventional press-type perfume bottles generally have a press-type spray head and a sucking tube connected with the spray head and extending in the perfume in a perfume bottle so as to spray the perfume out. However, the conventional press-type perfume bottles have a cap added to prevent the spray head from pressed by error, and the cap may fall to break or wear off owing to frequent pressing or excessive force in pressing, not so convenient to use.

SUMMARY OF THE INVENTION

The objective of the invention is to offer a perfume sprayer convenient to carry along and use.

The feature of the invention is a left half housing consisting of a left upper and a left lower cap, a right half housing consisting of a right upper and a right lower cap combined with the left half housing to form a complete housing of a perfume sprayer.

When the left lower cap and the right lower cap are pressed, a perfume bottle controlled immovable by a control member is released from the control member to move up to protrude out of an upper hole of the housing, and a spray nozzle of a spray head deposited on a perfume bottle contained in a bag may spray out the perfume contained in the perfume bottle positioned in chambers of the left lower cap and the right lower cap. When the perfume sprayer is no longer used, the control member is rotated to keep the bottle immovable, becoming impossible to spray the perfume out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
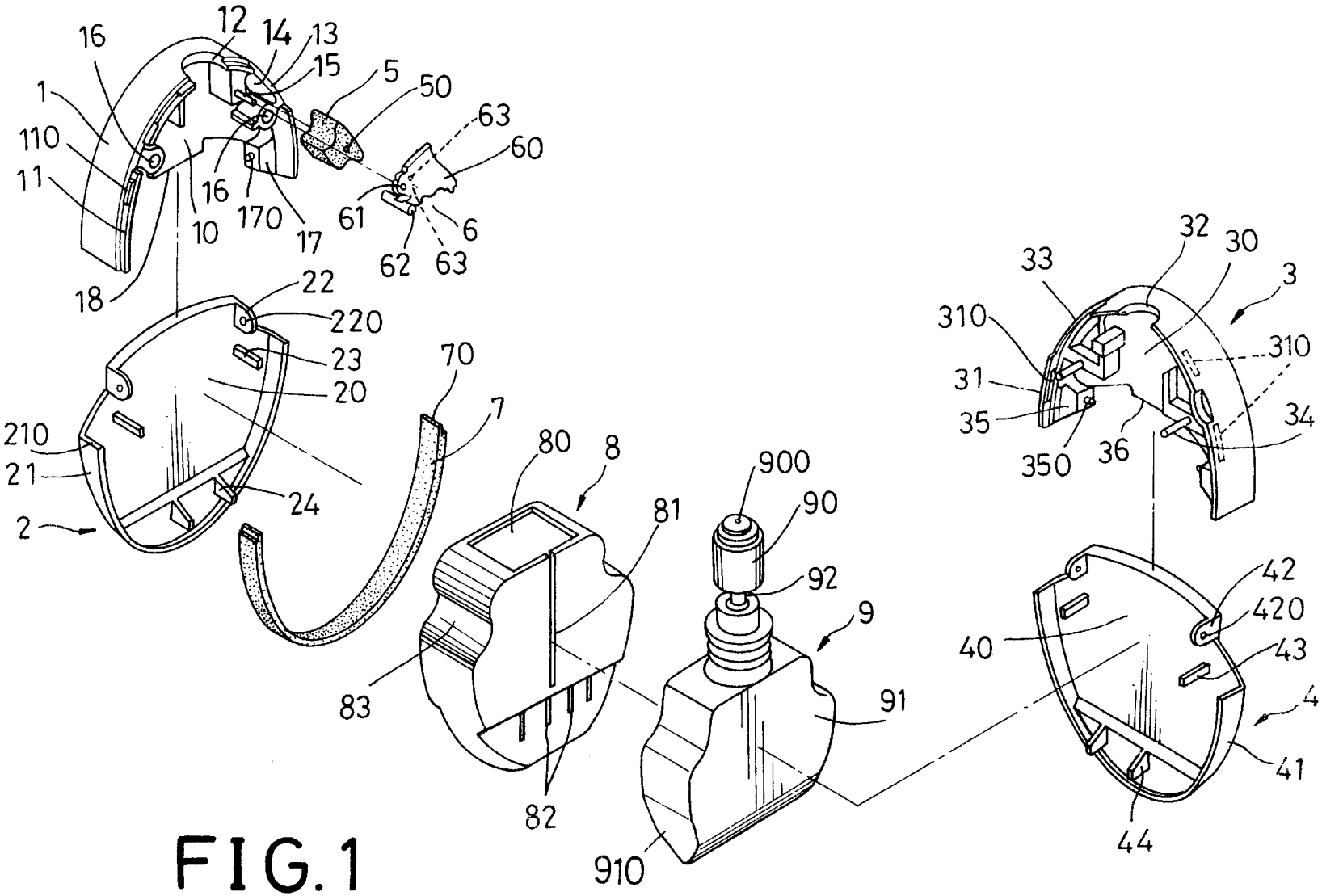
FIG. 1 is an exploded perspective view of a perfume sprayer in the present invention.

A preferred embodiment of a perfume sprayer in the present invention, as shown in FIG. 1, includes a left upper cap 1, a left lower cap 2, a right upper cap 3, a right lower cap 4, a gasket 5, a control member 6, a protective band 7, an elastic bag 8 and a bottle 8 as main components combined together.

The left upper cap 1 has an inner chamber 10, a circumferential projection edge 11, an insert block 110 formed on the projecting edge 11, a semicircular groove 12 formed in an upper intermediate portion, an elongate aperture 13 formed in a right side, a recess 14 formed in an inner side of the elongate aperture 13 for a gasket 5 to fit in, a sidewise rod 15 provided beside the recess 14, an insert groove 16 formed respectively at two sides of the chamber 10, a connect block 17 formed respectively to protrude inward on two sides of a lower portion, a pivot stud 170 provided sidewise on the connect block 17 to extend inward, and a stop plate 18 extending downward from an intermediate lower portion.

The left lower cap 2 is pivotally connected to the left upper cap 1 to make up a left half housing, having an inner chamber 20, a bent circumferential edge 21 having two ends 210, two wings 22 bending inward from an upper side in the chamber 20, a pivot hole 220 bored in each wing 22 to connect pivotally with the pivot stud 170 of each connect block 17 of the left upper cap 1, two sidewise posts 23 formed spaced apart in the chamber 20 and two push blocks 24 provided sidewise spaced apart under the chamber 20.

The right upper cap 3 is pivotally connected to the right lower cap 4 to make up a right half housing to combine with the half housing so as to form a complete housing for the perfume sprayer. The right upper cap 3 has an inner chamber 30, a projecting circumferential edge 31, an insert groove 310 provided on the projecting edge 31 to fit in the insert block 110 of the left upper cap 1, two sidewise insert rods 34 formed at two sides of the chamber 30 to fit with the insert grooves 16 of the left upper cap 1, a connect block 35 respectively provided at two sides in a lower portion and having a pivot stud 350, and a stop plate 36 extending downward from an intermediate portion.

The right lower cap 4 is pivotally connected to the right upper cap 3, having an inner chamber 40, a bent circumferential edge 41, two wings 42 bending inward from an upper portion of the chamber 40 and having a pivot hole 420 for the pivot stud 350 of the connect block 35 of the right upper cap 3 to fit in, two sidewise posts 43 provided spaced apart in the chamber 40, and two push blocks 44 provided in a lower portion to position side by side with the push blocks 24 of the left lower cap 2.

The gasket 5 is contained in the recess 14 of the left upper cap 1, having the same shape and size as the recess 14 and a stud 50 protruding on a surface.

The control member 6 is deposited up on the gasket 5, having a pull block 60 of a flat shape, and its outer edge partly protruding out of the apertures 13 and 33 of the left upper cap 1 and the right upper cap 3, a hole 61 bored in an inner side for the rod 15 of the left upper cap 1 to pass through, a stop rod 62 formed in an inner end, and plural position recesses 63 formed in the surface of the pull block 60 to face the stud 50 of the gasket 5.

The protective band 7 is made of rubber to have flexibility, positioned around the projection circumferential edges 21 and 41 of the left lower cap 2 and the right lower cap 4, having two ends 70 adhered with the ends of the circumferential projecting edge 21 of the left lower cap 2.

The bag 8 made of flexible material is contained in the chambers 20 and 40 of the let lower cap 2 and the right lower cap 4, having an opening 80 in an upper side, a vertical slot

81 cut in an intermediate portion and reaching the opening 80, plural holes 82 formed spaced apart in a lower portion for the push blocks 24 and 44 of the left lower cap 2 and the right lower cap 4 to insert therein, and a concave outer surface 83 formed respectively in two outer sides near the upper side.

In assembling, referring to FIGS. 1–6, firstly, put the stop plate 18 between the two wings 22 of the left lower cap 2, with the pivot stud 170 of connect block 17 fitting in the pivot hole 220 of the wing 22 to form the left half housing. Next, place the gasket 5 in the recess 14 of the left upper cap 1, and deposit the control member 6 on the gasket 5, with the rod 15 passing through the hole 61. Then the control member 6 can rotate with the rod 15 as a pivot, letting the stud 50 of the gasket 5 engaging with one of the position recesses 63 in the pull block 60 to keep the gasket 5 immovable. Then put the bag 8 in the chamber 20 of the left lower cap 2 with the top of the bag 8 fit between the two wings 22 and the concave surface 83 stopped in place by the sidewise post 23. After that, insert the pull blocks 24 of the left lower cap 2 in the two holes 82 of the bag 8, and adhere the two ends 70 of the protective band 7 with the ends 210 of the bending edge 21 of the left lower cap 2. Then the bottle 9 is placed in the bag 8 through the slot 81, with the sloping surface 910 of the bottle body 91 located on the push blocks 24, with the spray head 90 extending out of the chamber 10 of the left upper cap 1, and with the spray nozzle 900 located in the recessed groove 12, and with the stop rod 62 fitting in the neck 92. Next, the right upper cap 3 and the right lower cap 4 are combined together pivotally in the same way the right upper cap 1 and the left lower cap 2 are combined together, forming the right half housing. Then the left half housing and the right half housing are combined with each other to form a complete housing, with the insert rod 34 inserting in the insert groove 16, with the insert block 110 of the circumferential edges 11 of the left upper cap 1 inserting in the insert groove 310 of the circumferential edge 31 of the right upper cap 3, and with the push blocks 44 of the right lower cap 4 extending in the holes 82 of the bag 8 to push the sloping surface 910 of the bottle 9. Then the perfume sprayer in the invention is finished in assembly.

Figure 3:
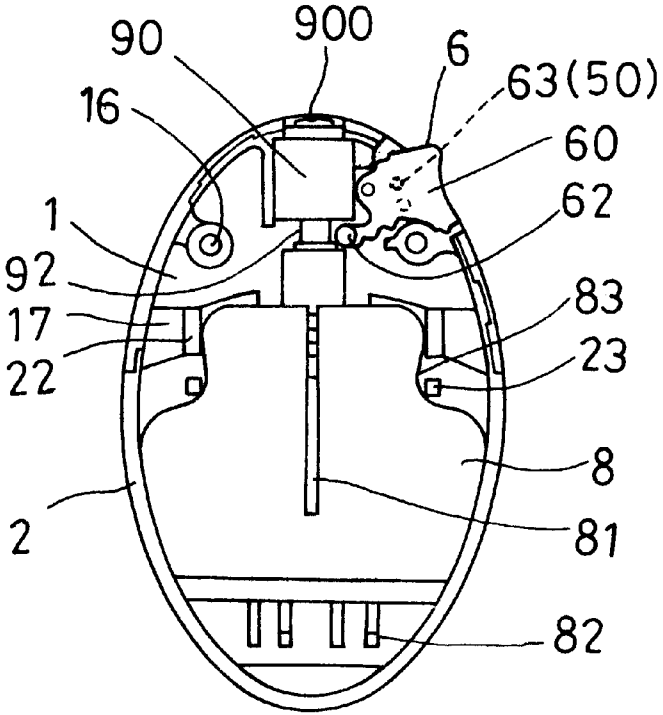
FIG. 3 is a front cross-sectional view of the perfume sprayer in the present invention.
Figure 2:
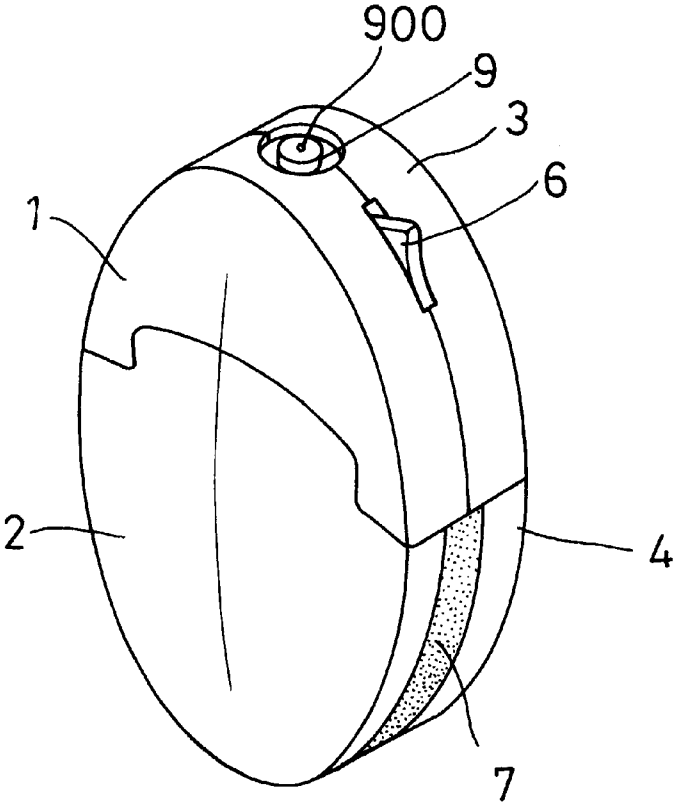
FIG. 2 is a perspective view of the perfume sprayer in the present invention.
Figure 6:
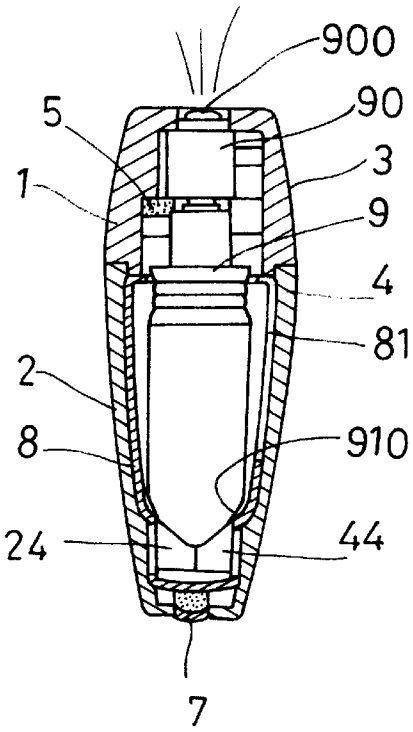
Figure 5:
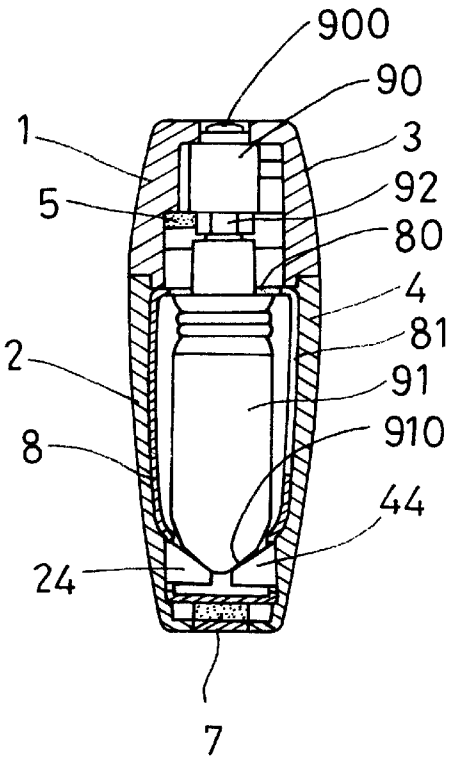
FIG. 5 is a side cross-sectional view of the perfume sprayer in the present invention; and, FIG. 6 is a side cross-sectional view of the perfume sprayer being used in the present invention.
Figure 4:
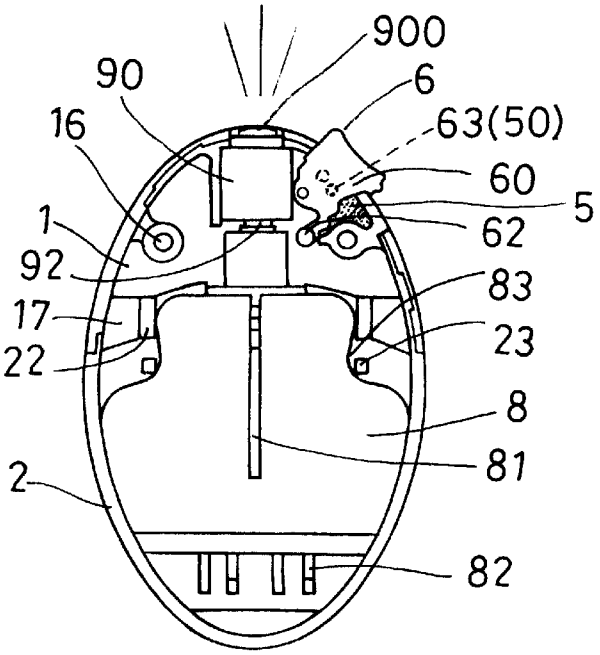
FIG. 4 is a front cross-sectional view of the perfume sprayer with a control member being moved in the present invention.

In using, referring to FIGS. 3 and 4, pull the control member 6 to rotate upward, forcing the stop rod 62 separate from the neck 92 of the bottle 9 and the stud 50 of the gasket 5 fit in one of the position recesses 63 (also FIGS. 3 and 4 referred). Next, manually press the left lower cap 2 and the right lower cap 4, forcing the push blocks 24 and 44 push up the bottle 9 along the sloping surface 910. Thus the spray nozzle 900 of the bottle 9 can spray the perfume out of the bottle 9 as shown in FIGS. 4, 5 and 6. Provided the perfume sprayer is no longer to be used, just rotate the pull block 60 of the control member 6, letting the stop rod 62 move to fit in the neck 92 of the bottle 9, with the stud 50 of the gasket 5 engage with one of the position recesses 63 as shown in FIG. 3. Then the perfume sprayer cannot be pressed to spray the perfume out of the bottle.

The perfume sprayer in the invention has the following advantages, as can be understood from the aforesaid description.

1. It is easy to assemble and disassemble, and convenient to replace the bottle with a new one.

2. The bottle can be positioned in the bag stably, permitting the whole perfume sprayer carried with convenience for use.

3. It is easy to carry out along by a user.

4. Its configuration is extremely beautiful, fresh and practical.

While the preferred embodiment of the invention has been described above, it will be recognized and understood that various modifications may be made therein and the appended claims are intended to cover all such modifications that may fall within the spirit and scope of the invention.

What is claimed is:

1. A perfume sprayer comprising:

a left upper cap having a chamber in its interior, an insert groove respectively formed in two sides of said chamber, a semicircular recess formed in an upper portion, an inner circumferential edge, an insert block provided on said circumferential edge, and a connect block formed in two sides of a lower portion;

a left lower cap combined pivotally with said left upper cap, having a chamber in its interior, two wings formed at two ends of an upper side to combine with said connect block of said left upper cap, two push blocks formed spaced apart in a lower portion, and a bent circumferential edge in a lower portion;

a right upper cap, having a chamber in its interior, an insert rod provided in said chamber to insert in said insert groove of said left upper cap, a recess formed in an inner edge of an upper portion, an inner circumferential edge formed in a lower portion, an insert groove formed on said inner circumferential edge to fit with said circumferential edge of said left upper cap, and a connect block formed each in a lower portion;

a right lower cap combined pivotally with said right upper cap, having a chamber in its interior, two wings formed spaced apart in an upper portion to combine with said connect blocks of said right upper cap, two push blocks formed spaced apart under said chamber, and a bent inner circumferential edge;

a perfume bottle contained in said left lower cap and said right lower cap, having a spray head on an upper side and extending in said chambers of said left upper cap and right upper cap, a spray nozzle of said spray head just facing said recess of said left upper cap and said right upper cap, a sloping surface formed in a lower portion and kept in place by said push block of said lower cap and said right lower cap;

said left lower cap and said right lower cap manually pressed to force said push blocks move up along said sloping surfaces of said perfume bottle so that the perfume in said bottle may be sprayed out, said perfume sprayer being convenient to carry out for use and having a beautiful configuration and being practical.

2. The perfume sprayer as claimed in claim 1, wherein said left upper cap and said right upper cap both have an aperture in a side to face each other, and a recess and a sidewise rod are provided in each said aperture.

3. The perfume sprayer as claimed in claim 1, wherein said connect blocks of said left upper cap and said right upper cap both have a pivot stud provided in an inner side, a stop plate formed in an intermediate portion of said chamber said pivot stud and said stop plate respectively fitting in said two wings, said wings having a pivot hole for said stud of said connect block to fit therein, and a sidewise post provided in said chambers of said left lower cap and said right lower cap.

4. The perfume sprayer as claimed in claim 1, wherein a flexible protective band made of flexible material is further provided to extend around said bent circumferential edges of said left and said right lower cap, having two ends adhered to the two ends of said bent circumferential edges.

5. The perfume sprayer as claimed in claim 1, wherein said perfume bottle is further contained in a bag made of flexible material, said bag contained in said chambers of said left lower cap and said right lower cap, having an opening formed in an upper side, a vertical slot cut in an intermediate portion and extending to said opening, plural vertical holes formed in a lower portion for said push blocks of said right lower cap and said right lower cap to fit therein, a concave outer surface formed in an outer intermediate portion, an upper side of said bag located between said wings of said left lower and said right lower cap, and said concave outer surface fitted in by said post to be restricted in its position.

6. The perfume sprayer as claimed in claim 2, wherein a gasket is fitted in said recess of said left upper cap, said gasket has a stud on its outer surface, and a control member is deposited on said gasket, having a pull block of a plate shape and an outer edge protruding out of said aperture of said left upper cap, said pull plate having a stop rod formed at one side of said pull plate to face a neck of said bottle, said stop rod fitting in said neck of said bottle to keep said bottle immovable, said pull plate also having a hole for said sidewise rod to pass through and plural position recesses for said stud to fit in one of them to keep said control member immovable in case of said control member being rotated.

* * * * *